US010238986B2

(12) United States Patent
Peru et al.

(10) Patent No.: US 10,238,986 B2
(45) Date of Patent: Mar. 26, 2019

(54) FLYING DISC

(71) Applicant: ZipChip Sports LLC, Fairfield, CT (US)

(72) Inventors: Alex Peru, Fairfield, CT (US); Richard Opalenik, Wallingford, CT (US)

(73) Assignee: ZipChip Sports, LLC, Fairfield, CT (US)

( * ) Notice: Subject to any disclaimer, the term of this patent is extended or adjusted under 35 U.S.C. 154(b) by 0 days.

(21) Appl. No.: 14/873,307

(22) Filed: Oct. 2, 2015

(65) Prior Publication Data

US 2017/0095748 A1 Apr. 6, 2017
US 2017/0203227 A9 Jul. 20, 2017

Related U.S. Application Data

(60) Provisional application No. 62/059,052, filed on Oct. 2, 2014.

(51) Int. Cl.
*A63H 33/18* (2006.01)
*A63H 23/10* (2006.01)

(52) U.S. Cl.
CPC ..... *A63H 33/18* (2013.01); *A63H 23/10* (2013.01)

(58) Field of Classification Search
CPC ..... A63H 27/00; A63H 33/18
See application file for complete search history.

(56) References Cited

U.S. PATENT DOCUMENTS 3,201,128 A * 8/1965 Palovik ..... A63B 67/14 273/127 R
3,724,122 A * 4/1973 Gillespie, Sr. ..... A63H 33/18 446/46
4,463,954 A * 8/1984 Panse ..... A63H 33/18 441/67
5,836,840 A * 11/1998 Bustamante ..... A63H 33/18 473/588
5,845,908 A * 12/1998 Reichardt ..... A63F 7/40 273/317
6,179,737 B1 * 1/2001 Adler ..... A63B 65/10 446/46
6,383,052 B1 * 5/2002 McCarthy ..... A63H 33/18 446/153
7,500,900 B2 * 3/2009 Wolfe, Jr. ..... A63H 33/18 446/460
8,246,497 B1 * 8/2012 Garcia ..... A63B 65/00 446/48
8,870,619 B1 * 10/2014 Morgan ..... A63H 23/10 446/46

(Continued)

*Primary Examiner* — Gene Kim
*Assistant Examiner* — Alyssa Hylinski
(74) *Attorney, Agent, or Firm* — St. Onge Steward Johnston & Reens, LLC

(57) ABSTRACT

A flying disc includes a substantially circular body having a top and a bottom and a groove extending around a perimeter of the body between the top and the bottom. The top of the body has an edge member around the outer perimeter of the top, and a domed portion in a central area of the top. A portion of the top between the edge member and the domed portion is inwardly curved. The bottom has an edge member around the outer perimeter of the bottom, a substantially planar portion in a central area of the bottom, and an inwardly curved portion between the edge member and the substantially planar portion.

26 Claims, 15 Drawing Sheets

(56) References Cited

U.S. PATENT DOCUMENTS

| | | | | |
|---|---|---|---|---|
| 2003/0134561 | A1* | 7/2003 | Fontaign | A63H 33/18 446/46 |
| 2005/0153628 | A1* | 7/2005 | Wolfe, Jr. | A63H 33/18 446/460 |
| 2012/0225739 | A1* | 9/2012 | Cheshire | A63B 63/06 473/416 |

* cited by examiner

SECTION A-A

FLYING DISC

FIELD

The aspects of the present disclosure relate generally to game and sport discs, and more particularly to a small sized game and sport disc for throwing and catching.

BACKGROUND

Hand thrown flying toys, and in particular flying discs such as the FRISBEE™ are popular recreational toys and sporting good. Flying discs are available for a variety of different sports and games such as ultimate FRISBEE™, disc golf, catching, distance throwing, and canine disc sports.

However, throw and catch toys that can be used at distances (40+ yards), such as a FRISBEE™, flying or throwing discs, baseballs and footballs, tend to be of a large size and do not fit well in one's pocket, if at all. For example, standard-sized FRISBEE™ devices or flying discs are big and can be at least 12 inches in diameter. Smaller and miniaturized flying discs tend to be proportional to the larger ones, and are typically too light for long flights. Folding and soft style flying discs tend not to be great flyers, and even in their folded state, tend to be large. Further, miniaturized flying discs are designed to be thrown in the backhand style which tends to limit the thrower's ability to throw the disc at varying pitch angles in hopes of achieving varying flight patterns.

Accordingly, it would be desirable to provide a flying disc that addresses at least some of the problems identified above.

BRIEF DESCRIPTION OF THE DISCLOSED EMBODIMENTS

As described herein, the exemplary embodiments overcome one or more of the above or other disadvantages known in the art.

One aspect of the exemplary embodiments relates to a flying disc. In one embodiment, the flying disc includes a substantially circular body having a top and a bottom and a groove extending around a perimeter of the body between the top and the bottom. The top of the body has an edge member around the outer perimeter and a domed portion in a central area of the top. A portion of the top between the edge member and the domed portion is inwardly curved. The bottom has an edge member around the outer perimeter, a substantially planar portion in a central area of the bottom, and an inwardly curved portion between the edge member and the substantially planar portion.

Another aspect of the disclosed embodiments is directed to a flying disc. In one embodiment, the flying disc includes a cylindrical body with a diameter that is greater than its height. The body has an upper surface, a lower surface and a side surface between the upper surface and the lower surface. The upper surface has an outer edge member extending around a perimeter of the body and a central dome member. An area between the outer edge member and central dome member is inwardly curved. The lower surface has an outer edge member around the perimeter of the body and a inwardly cupped portion within the outer edge.

These and other aspects and advantages of the exemplary embodiments will become apparent from the following detailed description considered in conjunction with the accompanying drawings. It is to be understood, however, that the drawings are designed solely for purposes of illustration and not as a definition of the limits of the invention, for which reference should be made to the appended claims. Additional aspects and advantages of the invention will be set forth in the description that follows, and in part will be obvious from the description, or may be learned by practice of the invention. Moreover, the aspects and advantages of the invention may be realized and obtained by means of the instrumentalities and combinations particularly pointed out in the appended claims.

BRIEF DESCRIPTION OF THE DRAWINGS

The accompanying drawings illustrate presently preferred embodiments of the present disclosure, and together with the general description given above and the detailed description given below, serve to explain the principles of the present disclosure. As shown throughout the drawings, like reference numerals designate like or corresponding parts.

DETAILED DESCRIPTION OF THE EXEMPLARY EMBODIMENTS OF THE DISCLOSURE

The aspects of the disclosed embodiments are directed to a palm or pocket sized disc that is configured to be thrown and fly through the air, also referred to herein as a flying disc. The flying disc of the disclosed embodiments will be approximately two to three inches in diameter and have a height dimension of less than approximately one inch. The size of the flying disc of the disclosed embodiments allows the disc to fit comfortably into a pocket of the person's clothing. The disc includes a perimeter groove that allows the disc to be held like a skipping stone and be thrown in a similar fashion. The flying disc of the disclosed embodiments is configured for flight in excess of 70 yards, and can be caught by the person's bare hand.

Figure 1:
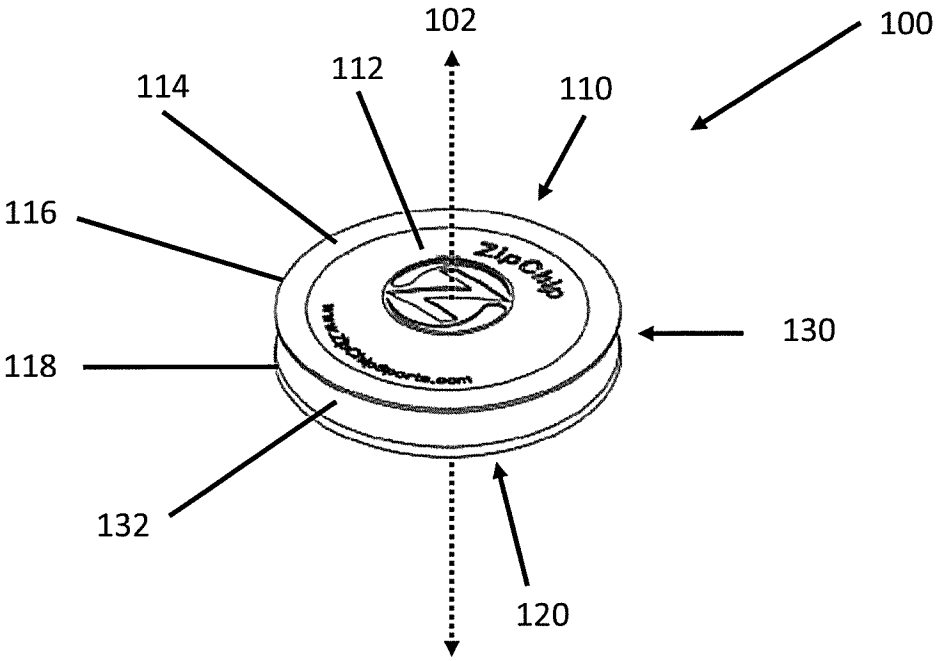
FIG. 1 is a perspective view of a disc incorporating aspects of the disclosed embodiments.

FIG. 1 illustrates a disc 100 incorporating aspects of the disclosed embodiments. In this example, the disc 100 has a body that is substantially circular or cylindrical in form, where a diameter of the disc 100 is greater than the height. As illustrated in FIG. 1, the disc 100 is substantially radially symmetric about a central vertical axis 102. As will be described further herein, an outer diameter of the disc 100 is in a range of approximately two to three inches, and a height of the disc 100 generally less than approximately one inch. In alternate embodiments, the outer diameter of the disc 100 can be any suitable diameter, such as 3 to 3.5 inches.

In one embodiment, a weight of the disc 100 is in a range of approximately 0.5 to and including 2 ounces. For example, in the embodiment of FIG. 1, the disc 100 has a diameter of approximately 2.5 inches and a weight of approximately 0.75 ounces. For a disc 100 having a diameter of approximately 3 to 3.5 inches, a weight of such as disc can be approximately 1.5 to and including 2.0 ounces. In alternate embodiments, the disc 100 can comprise any suitable dimensions and weight, as described herein, that will provide the small size and flight characteristics as is described herein.

The volume of material used in the fabrication of the disc 100 relative to the diameter of the disc 100 advantageously provides certain flight characteristics. The weight of the disc 100 relative to its size allows the disc 100 to be thrown farther than might be realized with a scaled down version of a conventional disc, such as a Frisbee™, and in some cases, with more accuracy. In one embodiment, an exemplary weight-to-area ratio of the disc 100 is in the range of approximately 4.5 to 5.5 grams per square inch. For example, in the embodiment of FIG. 1, the diameter of the disc 100 is approximately 2.5 inches. For this diameter, the disc 100 has a weight of approximately 0.75 ounces. The weight of the disc 100 of the disclosed embodiments relative to its size, including the diameter and height, enables the disc 100 to fly farther and in some cases with more accuracy, than merely scaled down versions of conventional flying discs.

As an exemplary comparison, the disc 100 illustrated in FIG. 1, is approximately 2.5 times heavier than a standard 10.75 inch Ultimate Frisbee™ has a weight of approximately 175 grams. The circumference of the disc 100 shown in FIG. 1 creates an area of approximately 4.9 square inches, with a weight of approximately 23.8 grams. This results in a weight to area ratio of approximately 4.86 grams per square inch. A conventional disc, such as the Ultimate Frisbee™ referred to above, has a weight to area ratio of approximately 1.93 grams per square inch. Merely scaling such a disc down to the size of the disc 100 will not result in the disc 100. The weight of such a disc, scaled down to the diameter of the disc 100, would only be 40% of the weight of the disc 100. Such as disc would not fly as far as the disc 100 when thrown. Some of the heaviest golf discs that are not meant to be caught have a maximum weight to area ratio of approximately 3.5 grams per square inch. The golf discs are generally made of a material that weighs more, or is denser, than the material of the disc 100. The weight of the disc 100 is generally dependent upon the type of material used. It is noted that in one embodiment, the disc 100 is configured to float, particularly when used in water.

The material of the disc 100 generally comprises a soft, flexible material, such as rubber or a rubber-like material. The disc 100 is configured to be lightweight, soft, durable and water proof or water resistant. Examples of a suitable material for the disc 100 can include, but are not limited to a thermoplastic material or rubber (TPR), a thermoplastic elastomer (TPE), a thermoplastic polyurethane (TPU) or other rubber like material. The disc 100 generally comprises a one-piece disc that can be produced using hard-plastic injection moulding.

Figure 2:
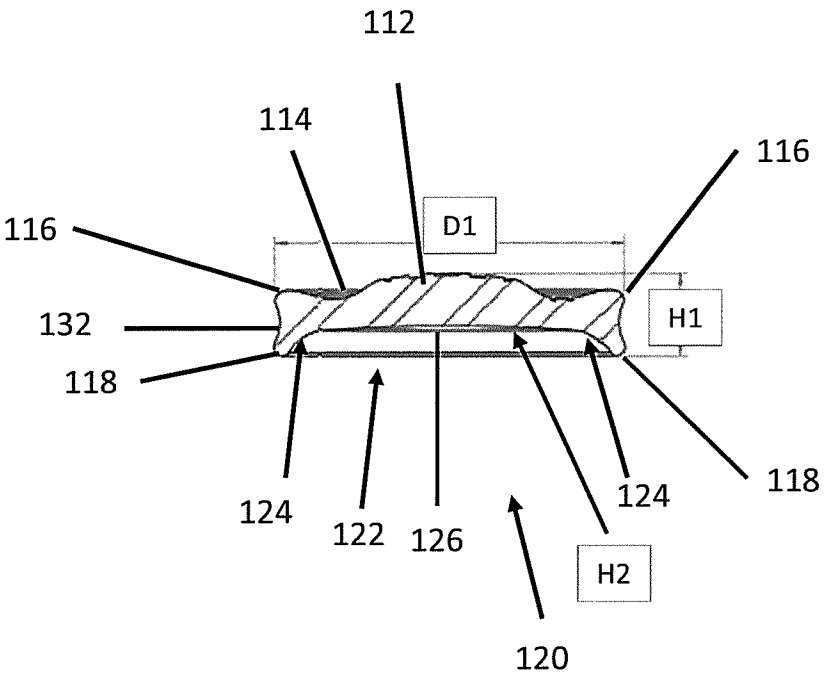
FIG. 2 is a cross-sectional view of the disc illustrated in FIG. 1.

In the example of FIG. 1, the disc 100 generally comprises a top part or upper surface 110, a bottom part or lower surface 120 and a side part or perimeter portion 130. The top part 110 of the disc 100 includes a center or domed section 112 and is defined by an outer edge or rim member 116, generally referred to as the upper rim or edge 116. The area 114 between the dome section 112 and the outer edge is curved. In the example of FIGS. 1 and 2, the area 114 is inwardly curved, or is generally concave in shape and form, with a curvature as will be described herein. In one embodiment, the area 114 can be referred to as a groove that has a circular form around the upper surface 110.

Figure 4:
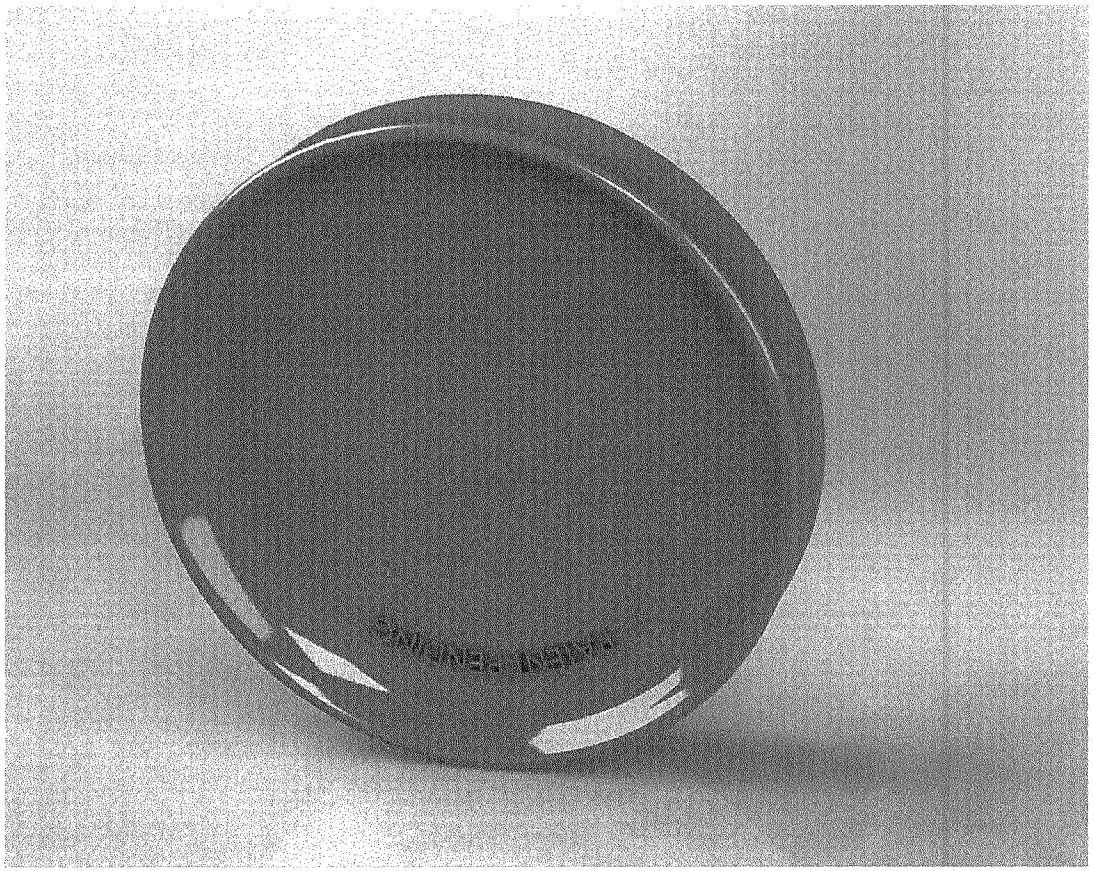
FIG. 4 is a bottom view of one embodiment of a disc incorporating aspects of the disclosed embodiments.

Referring also to FIGS. 2 and 4, the bottom part or lower surface 120 is defined by an outer edge or rim member, also referred to as the lower edge or rim 118, and a cavity or cupped section 122. In one embodiment, the cupped section 122 includes curved portions 124 on either side of a substantially planar section 126.

As shown in FIGS. 1 and 2, the side part 130 generally comprises or shares the upper rim 116 and lower rim 118. The area 132 between the upper rim 116 and lower rim 118 extends around a perimeter of the disc 100, also referred to herein as perimeter groove 132. The perimeter groove 132 is generally concave in shape and form. As shown in the example of FIG. 2, the perimeter groove 132 curves inwardly.

Figure 3:
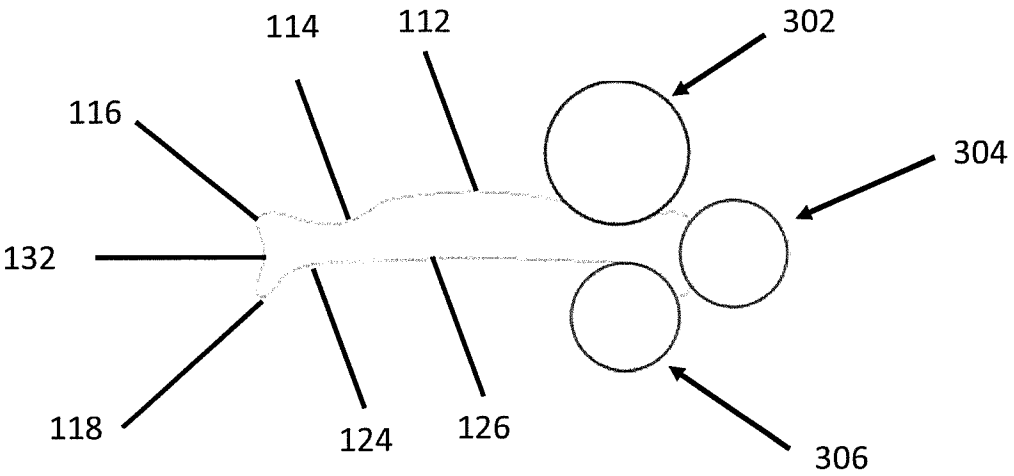
FIG. 3 illustrates exemplary curvatures of the domed portion, the perimeter portion and the cup portion of a disc incorporating aspects of the disclosed embodiments.

Referring to FIGS. 2 and 3, in one embodiment, a diameter D1 of the disc 100 is in the range of approximately 2 inches to 3 inches. A preferred diameter D1 is approximately 2.5 inches. A height H1 of the disc 100 is generally less than one inch high. In one embodiment, a preferred height H1 is approximately ⅜ inches. In the example of FIGS. 1 and 2, a top of the domed section 112 has a height that extends or is slightly higher than the upper rim 116.

In the example shown in FIGS. 2 and 3, the domed section 112 of the top part 110 has a diameter of approximately 1 inch and a curvature 302 of the grooved portion 114 in the top 110 of the disc 100 is approximately ⅞ inches. The perimeter groove 132 has a curvature 304 in the range of approximately ⅝ inches to and including ¾ inches.

As shown in FIG. 2, in one embodiment, the underside or bottom portion 120 of the disc 100 has a generally cup-shaped form. A height or depth H2 of the bottom portion 120 is approximately 3/16 inches. As shown in FIG. 3, the curvature 306 of the curved portion 124 in the cupped section 122, also referred to as a flare, is approximately ⅝ inches. An inner diameter of the cupped section 122, or the planar section 126, is in the range of approximately two inches to and including two and one-quarter inches.

As noted above, the disc 100 of the disclosed embodiments has a weight-to-area ratio that is much higher than the conventional flying disc type devices. In one embodiment, the weight-to-diameter ratio can be greater than approximately 4.5 grams per square inch. This allows the disc 100 to be thrown for long distances, despite its smaller size compared to conventional flying discs. Unlike a conventional flying disc device, the weight-to-diameter ratio enables the disc 100 to be thrown with a high angle of attack and a quickly rising flight.

As noted above, the disc 100 of the disclosed embodiments is generally a one-piece rubber disc. Injection moulding is a preferred method of forming the disc 100. In one embodiment, the disc 100 can comprise a two-part assembly.

In this example, the disc 100 comprises a soft rim member surrounding a hard central disc member. Another embodiment can include a non-solid disc with air pockets or holes in the disc member. In a further embodiment, the disc member could include a hole in the center to allow the disc to be worn as a bracelet.

Figure 5:
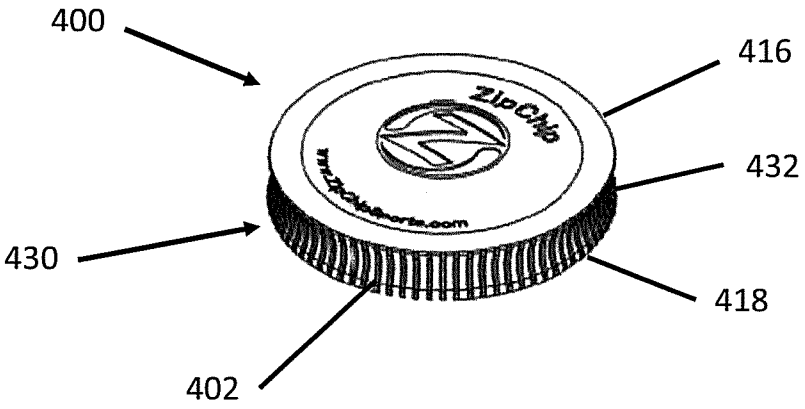
FIG. 5 is a perspective view of a disc incorporating aspects of the disclosed embodiments.
Figure 6:
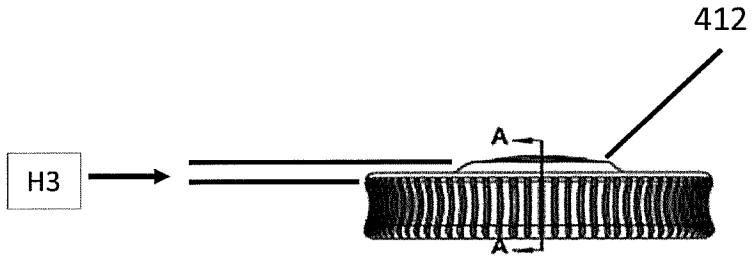
FIG. 6 is a side view of the exemplary disc illustrated in FIG. 4.
Figure 7:
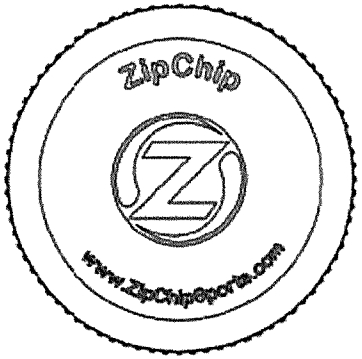
FIG. 7 is a top plan view of the exemplary disc illustrated in FIG. 5.
Figure 9:
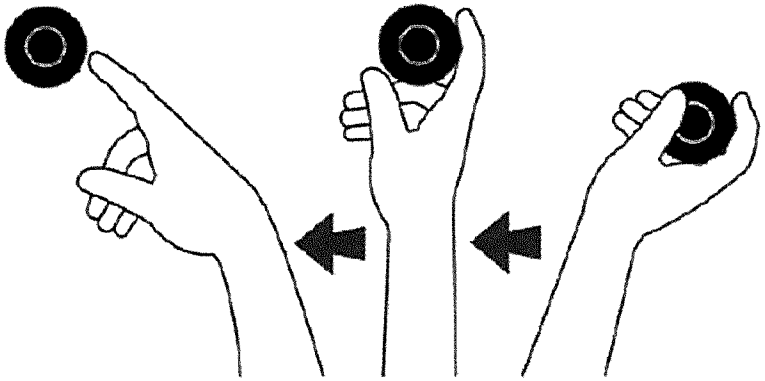
FIG. 9 illustrates an exemplary method of use of a disc incorporating aspects of the disclosed embodiments.

FIGS. 5-7 illustrate another example of a disc 400 incorporating aspects of the disclosed embodiments. In this example, the side or outer perimeter 430 of the disc 400 includes rib members 402. The individual rib members 402 extend from the upper rim 416 to the lower rim 418 along the perimeter groove 432. The ribbed members 402 can provide additional gripping action. The finger wrapped around the perimeter needs not to slip, as shown in FIG. 9. The ribbed members 402 provide texturing to assist in the gripping.

FIG. 6 illustrates an example of how the domed section 412 extends above the upper rim 416 by as distance H3. This is also illustrated in the example of FIG. 12, where the disc 500 is shown in an inverted or upside down state.

Figure 8:
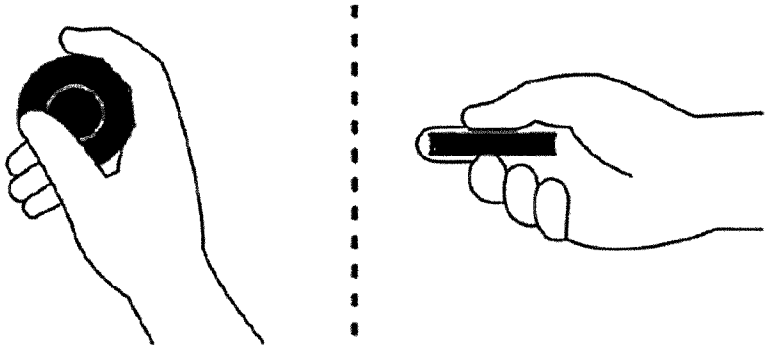
FIG. 8 illustrates an exemplary method of use of a disc incorporating aspects of the disclosed embodiments.

Referring to FIGS. 8 and 9, one method of using a disc incorporating aspects of the disclosed embodiments is illustrated. The disc 100 illustrated in FIG. 1 is configured to be thrown and caught. Other actions can include throwing the disc at targets, throw the disc for distance and used for yard games. The size, shape and design of the disc 100 allow the disc to be thrown forehand with the index finger wrapped around the perimeter groove 122. This allows the disc 100 to achieve greater distance and accuracy while remaining easily catchable. Yet, the size and weight of the disc 100 allows the disc to be easily carried in one's pocket.

For example, as is shown in FIG. 8, the user places the disc 100 in the throwing hand with the upper surface or domed side 110 facing up. The user places their index finger in the perimeter groove 122 along the side or perimeter groove 130 of the disc 100. The exact placement of the other fingers is less critical. The thumb may be on the top of the disc in the domed region 112, such as shown in FIG. 8, or an edge of the disc. The remaining three fingers can be placed underneath the disc.

Figure 10:
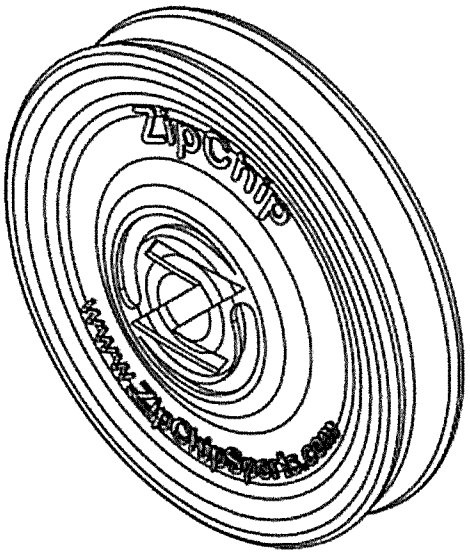
FIG. 10 is a perspective view of a disc incorporating aspects of the disclosed embodiments.
Figure 11:
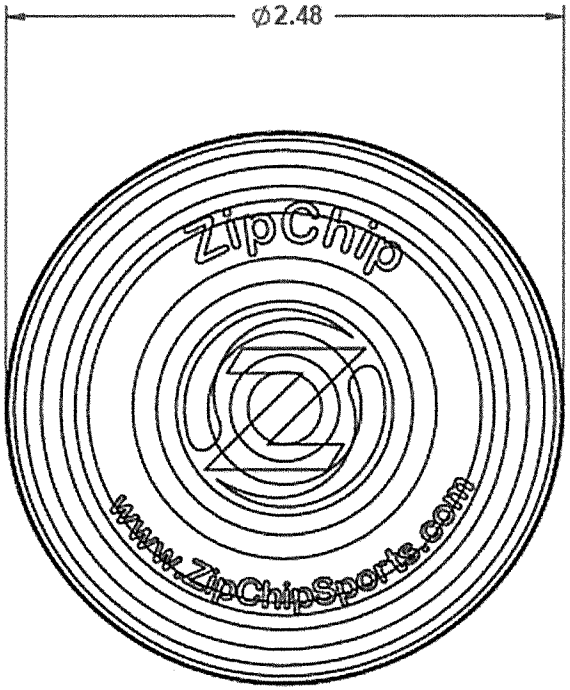
FIG. 11 is a top view of the exemplary disc illustrated in FIG. 10.
Figure 12:
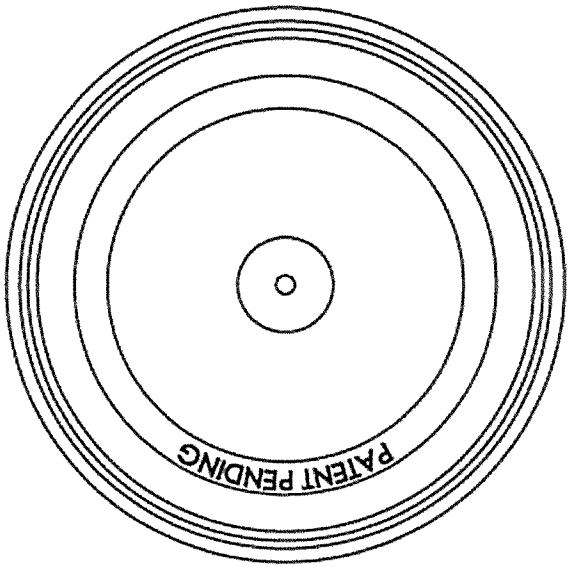
FIG. 12 is a bottom plan view of the exemplary disc illustrated in FIG. 10.
Figure 13:
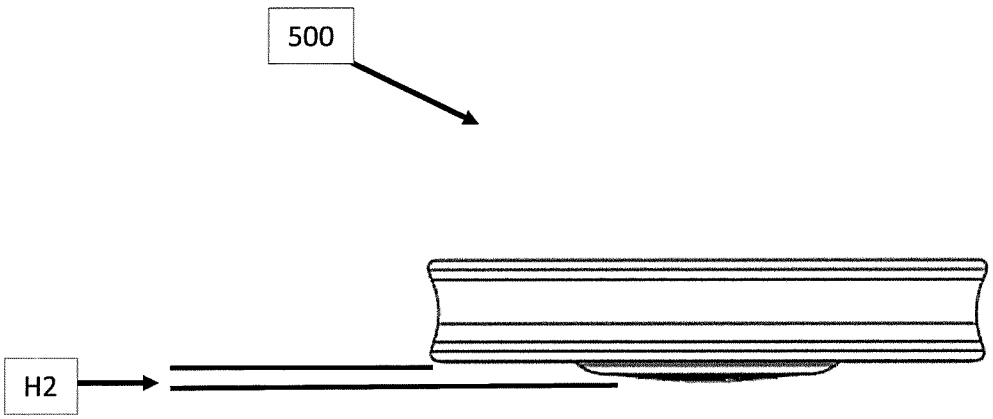
FIG. 13 is a side view of the exemplary disc illustrated in FIG. 10.
Figure 14:
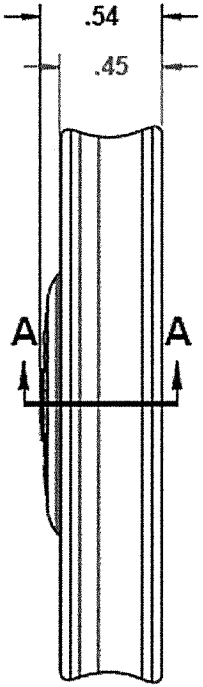
FIG. 14 is a another side view of the exemplary disc illustrated in FIG. 10.
Figure 15:
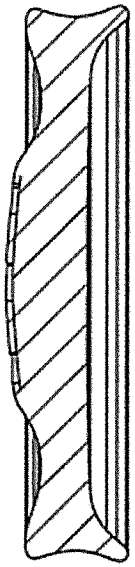
FIG. 15 is a cross-sectional view of FIG. 14.

FIGS. 10-15 illustrate another example of a disc incorporating aspects of the disclosed embodiments. In the examples of FIGS. 10-15, the ornamental aspects of a design incorporating aspects of the disclosed embodiments are illustrated. FIG. 10 is a perspective view, while FIGS. 11 and 12 are top and bottom views, respectively. FIG. 13 shows the disc positioned upside down, with the domed portion facing down. In the example of FIG. 13, the distance between an upper surface of the disc and the top of the domed section is illustrated. FIG. 14 is a side view, while FIG. 15 is a cross-sectional view of the disc taken along the line A-A. The dimensions illustrated in FIGS. 10-15 are merely exemplary, and provide only one example of a disc incorporating aspects of the disclosed embodiments.

The aspects of the disclosed embodiments provide a disc that is configured to be thrown and caught, also referred to as a flying disc. The flying disc is small in size, generally around 2.5 inches in diameter and having a height of approximately one inch. The weight-to-area is approximately 4.5. The volume of the flying disc of the disclosed embodiments relative to its size advantageously enables the flying disc of the disclosed embodiments to be thrown for long distances. The flying disc of the disclosed embodiments includes a domed section, a perimeter groove section and cupped section in the bottom of the disc to provide improved flight characteristics over more conventional flying discs.

Thus, while there have been shown, described and pointed out, fundamental novel features of the invention as applied to the exemplary embodiments thereof, it will be understood that various omissions and substitutions and changes in the form and details of devices and methods illustrated, and in their operation, may be made by those skilled in the art without departing from the spirit of the invention. Moreover, it is expressly intended that all combinations of those elements and/or method steps, which perform substantially the same function in substantially the same way to achieve the same results, are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A flying disc, comprising:

a substantially circular body having a top and a bottom and a groove extending around a perimeter of the body between the top and the bottom;

the top of the body comprises a first edge member around an outer perimeter of the top, and a domed portion in a central area of the top, wherein a portion of the top between the first edge member and the domed portion comprises a first curved portion, the first curved portion being concave;

the bottom comprising a second edge member around an outer perimeter of the bottom, a substantially planar portion in a central area of the bottom, and a second curved portion between the second edge member and the substantially planar portion, the second curved portion being concave;

a first thickness between the first and second edge members is greater than a second thickness between the first curved portion and the substantially planar portion;

the first and second edge members being vertically aligned;

a diameter of the disc is in the range of 2 inches to 2.5 inches; and a ratio of a height of the disc as measured between the top of the domed portion and the bottom of the second edge member to the diameter of the disc is at least 0.15.

2. The flying disc of claim 1, wherein a height of the domed portion extends above a height of the first edge member around the outer perimeter of the top.

3. The flying disc of claim 1, wherein the first curved portion of the top between the first edge member and the domed portion has a concave form extending below the first edge member.

4. The flying disc of claim 3, wherein the second curved portion between the second edge member and the substantially planar portion of the bottom has a concave form.

5. The flying disc of claim 4, wherein the groove has a concave form.

6. The flying disc of claim 1, wherein a third thickness at a top of the dome portion measured between the top and bottom of the disc is greater than the second thickness but less than the first thickness.

7. The flying disc of claim 1, wherein the groove is inwardly curved between the first edge member and the second edge member.

8. The flying disc of claim 1, wherein the second curved portion is curved inwards.

9. The flying disc of claim 1, wherein the domed portion is convex relative to the first curved portion.

10. The flying disc of claim 1, wherein the height of the disc is greater than ⅜ inches and less than 1 inch.

11. The flying disc of claim 1, wherein the groove has a radius of curvature in the range of ⅝ inches to and including ¾ inches.

12. The flying disc of claim 10, wherein the first curved portion has a radius of curvature of approximately ⅞ inches.

13. The flying disc of claim 11, wherein the first curved portion has a radius of curvature of approximately ⅞ inches.

14. The flying disc of claim 10, wherein the second curved portion has a radius of curvature of approximately ⅝ inches.

15. The flying disc of claim 11, wherein the second curved portion has a radius of curvature of approximately ⅝ inches.

16. A flying disc, comprising:

a substantially circular body having a top and a bottom and a groove extending around a perimeter of the body between the top and the bottom;

the top of the body comprises a first edge member around an outer perimeter of the top, and a domed portion in a central area of the top, wherein a portion of the top between the first edge member and the domed portion comprises a first curved portion;

the bottom comprising a second edge member around the outer perimeter of the bottom, a first portion in a central area of the bottom located at a height above the second edge member, and a second curved portion between the second edge member and the first portion extending in an upward direction from the second edge member towards the domed portion;

wherein a weight-to-area ratio of the flying disc is in the range of approximately 2.5 to 18 grams per square inch.

17. The flying disc of claim 16, wherein the disc floats in water.

18. The flying disc of claim 16 wherein the first and second edge members align vertically.

19. A flying disc, comprising:

a cylindrical body with a diameter that is greater than its height, the body comprising an upper surface, a lower surface and a side surface between the upper surface and the lower surface;

the upper surface comprising a first outer edge member extending around a perimeter of the body and a central dome member, an area between the first outer edge member and central dome member being inwardly curved such that a portion of the area that is inwardly curved is located below both the first outer edge member and the central dome member;

the lower surface comprising a second outer edge member around the perimeter of the body and an inwardly cupped portion within the second outer edge member, the inwardly cupped portion extending towards a central portion of the lower surface in a direction of the upper surface such that the central portion is positioned at a height above the second outer edge member; and wherein a thickness of the disc at a center of the central dome member is greater than a smallest thickness of the portion of the area that is inwardly curved.

20. The flying disc of claim 19, wherein a surface of the inwardly cupped portion is substantially flat.

21. The flying disc of claim 20, wherein a diameter of the inwardly cupped portion of the lower surface is greater than a diameter of the central dome member of the upper surface.

22. The flying disc of claim 19, wherein a height of the central dome member is higher than a height of the first outer edge member around the upper surface.

23. The flying disc of claim 19, wherein the side surface is inwardly curved between the first outer edge member and the second outer edge member.

24. The flying disc of claim 23, wherein the first and second outer edge members are arranged vertically with respect to each.

25. The flying disc of claim 19, wherein a weight-to-area ratio of the cylindrical body is in the range of approximately 2.5 to 18 grams per square inch.

26. The flying disc of claim 19, wherein a thickness of the cylindrical body varies from the first outer edge towards the central dome and the thickness between the first and second outer edges is larger than a thickness between the upper and lower surfaces at a center of the central dome.

* * * * *